US008967577B2

(12) United States Patent
Jeansonne et al.

(10) Patent No.: US 8,967,577 B2
(45) Date of Patent: Mar. 3, 2015

(54) CABLE LOCK SYSTEM AND METHOD

(75) Inventors: Jeffrey Kevin Jeansonne, Houston, TX (US); Richard E. Hodges, Magnolia, TX (US); Mark H. Ruch, The Woodlands, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 609 days.

(21) Appl. No.: 13/321,565

(22) PCT Filed: Jun. 18, 2009

(86) PCT No.: PCT/US2009/047745

§ 371 (c)(1),
(2), (4) Date: Nov. 21, 2011

(87) PCT Pub. No.: WO2010/147584

PCT Pub. Date: Dec. 23, 2010

(65) Prior Publication Data

US 2012/0324962 A1 Dec. 27, 2012

(51) Int. Cl.

| | |
|---|---|
| ***A47B 91/00*** | (2006.01) |
| ***A47G 29/00*** | (2006.01) |
| ***B65D 19/00*** | (2006.01) |

(52) U.S. Cl.
USPC ..... 248/346.01; 248/346.03; 248/918

(58) Field of Classification Search
CPC ..... G06F 1/1632
USPC ..... 248/346.01, 346.03, 918
See application file for complete search history.

(56) References Cited

U.S. PATENT DOCUMENTS

| | | | | |
|---|---|---|---|---|
| 7,684,186 | B2 * | 3/2010 | Chang | 361/679.43 |
| 7,684,188 | B2 * | 3/2010 | Tzeng et al. | 361/679.57 |
| 2004/0075980 | A1 * | 4/2004 | Park | 361/686 |
| 2004/0120112 | A1 | 6/2004 | Mullen et al. | |
| 2004/0145864 | A1 * | 7/2004 | Usui et al. | 361/683 |
| 2005/0128687 | A1 * | 6/2005 | Liang et al. | 361/679 |
| 2006/0232926 | A1 * | 10/2006 | Homer et al. | 361/686 |
| 2007/0218726 | A1 | 9/2007 | Tanaka et al. | |

FOREIGN PATENT DOCUMENTS

| | | |
|---|---|---|
| CN | 101298896 | 11/2008 |
| KR | 200426000 | 9/2006 |
| KR | 20080078741 | 8/2008 |

OTHER PUBLICATIONS

International Searching Authority, International Search Report and Written Opinion, Appln No. PCT/US2009/047745, date of mailing Mar. 18, 2010, 10 p.

* cited by examiner

*Primary Examiner* — Amy J Sterling
(74) *Attorney, Agent, or Firm* — Brooks, Cameron & Huebsch, PLLC

(57) ABSTRACT

A cable locking system is provided. The cable lock system 100 includes a base member 110 having at least one aperture 120, a device latch 130, a cable latch 140, and a lock assembly 150 that is operably connected to the device latch and the cable latch. A device 610 can be detachably attached to the device latch. A cable 300 can be detachably attached to the cable latch. The cable latch can be disposed proximate the at least one aperture. The lock assembly can have at least three modes.

11 Claims, 5 Drawing Sheets

CABLE LOCK SYSTEM AND METHOD

BACKGROUND OF THE INVENTION

Description of the Related Art

The security of personal computers and computer peripherals is of primary importance in a commercial environment. Many personal computers and peripherals are supplied with various slots, notches, and/or adapters for accommodating security devices such as cable locks which can be used to secure the computer or peripheral to an immovable object such as furniture. These locking devices, often referred to as "Kensington" locks after the primary supplier of locking hardware, are generally intended for use on personal computers and peripherals that are not routinely "unlocked." The increasing frequency of "portable" personal computers and peripherals requires the use of alternative security methods that comport with the portable nature of the personal computer or peripheral device.

SUMMARY OF THE INVENTION

A cable locking system is provided. The cable lock system can include a base member having at least one aperture, a device latch, a cable latch, and a lock assembly that is operably connected to the device latch and a cable latch. A device can be detachably attached to the device latch. A cable can be detachably attached to the cable latch. The cable latch can be disposed proximate the at least one aperture. The lock assembly can have at least three modes.

A cable locking method is also provided. A lock assembly having at least three modes can be disposed within a base member. The base member can comprise at least one aperture; a device latch adapted for the detachable attachment of a device; a cable latch adapted for the detachable attachment of a cable, disposed proximate the at least one aperture; and, an operable connection between the lock assembly and the device latch and the cable latch. A first end of a cable can be attached to the cable latch. A device can be attached to the device latch. When the lock assembly is in the first mode, the cable can be detachably attached to the cable latch. When the lock assembly is in the second or third modes, the cable cannot be detached from the cable latch. When the lock assembly is in the first or second modes, the device can be detachably attached to the device latch. When the lock assembly is in the third position, the device cannot be detached from the device latch.

Another cable locking system is also provided. At least one aperture, a device latch, a cable latch and a lock assembly having at least three modes can be disposed within a base member. The lock assembly can be operably connected to the device latch and the cable latch. The device latch is adapted for the detachable attachment of a device. The cable latch can be disposed proximate the at least one aperture and can be adapted for the detachable attachment of a cable. The system can also include a cable comprising a flexible member, a first end, and a second end. The first end can comprise a cylindrical first portion having a first diameter, a cylindrical second portion, disposed coaxially proximate the first portion, having a second diameter less than the first diameter, and a cylindrical third portion, disposed coaxially proximate the second portion, having a diameter greater than the second diameter. The second end can comprise a closed loop.

BRIEF DESCRIPTION OF THE DRAWINGS

Advantages of one or more disclosed embodiments may become apparent upon reading the following detailed description and upon reference to the drawings in which.

DETAILED DESCRIPTION

Figure 1:
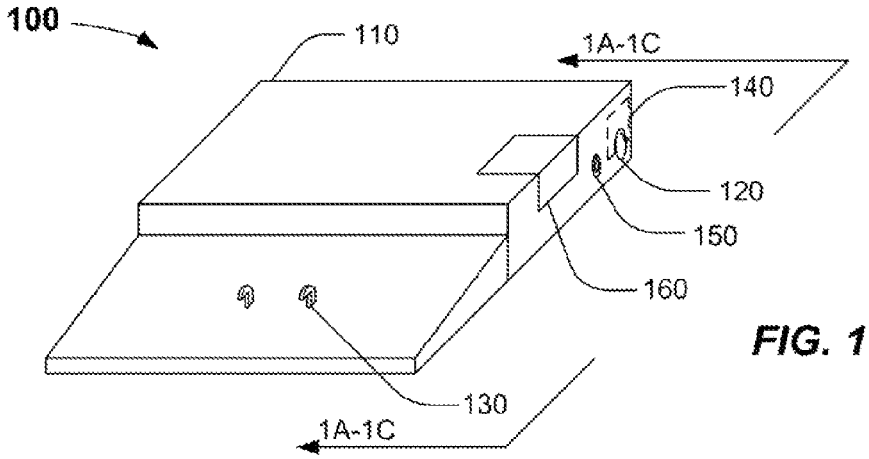
FIG. 1 is an upper-front perspective view of an exemplary cable lock system, according to one or more embodiments described herein.

FIG. 1 is an upper-front perspective view of an exemplary cable lock system 100, according to one or more embodiments. The exemplary cable lock system 100 can include, but is not limited to, the base member 110 having at least one aperture 120 disposed thereupon. One or more device latches 130 can be disposed partially or completely in, on, or about the base member 110. One or more cable latches 140 can be disposed partially or completely in, on, or about the base member 110. A lock assembly 150 can be partially or completely disposed in, on, or about the base member 110. In one or more embodiments, a cable latch 140 can be disposed proximate the aperture 120.

In one or more embodiments, the base member 110 can be any system, device, or combination of systems and/or devices in any number or frequency, suitable for the detachable attachment or docking and undocking of the one or more devices and one or more cables. In one or more embodiments, the base member 110 can be adapted to provide a docking station for one or more portable computing devices, for example one or more portable computers, one or more laptop computers, one or more "netbook" computers, or one or more ultraportable computers. In one or more embodiments, the base member 110 can be a hollow member or combination of hollow members suitable for providing a void space therein surrounded by or otherwise enclosed within a rigid, exterior, shell. In one or more embodiments, the base member 110 can be fabricated using any durable metallic or non-metallic material, for example plastic polymers, plastic co-polymers, or metallic or metal containing plastic polymers or co-polymers.

In one or more embodiments, one or more apertures 120 can be disposed in, on, or about the base member 110 thereby providing a fluid connection or passage between the interior and exterior of the hollow base member 110. The one or more apertures 120 can be of any shape, size geometry or orientation. In one or more embodiments, the one or more apertures 120 can provide access or communicative coupling capabilities with one or more systems, devices, or combinations of systems and/or devices disposed within the base member 110, for example one or more power inputs, input/output ("I/O") ports, network connections, peripheral connections, or the like.

The one or more device latches 130 can include any number of devices, systems, or combination of systems and devices suitable for temporarily or permanently attaching, affixing, engaging, or otherwise securing a device to the base member 110. In one or more specific embodiments, the device latch 130 can be hook-shaped, "J"-shaped, or "T"-shaped member suitable for disposal within a mating or complimentary receptacle or aperture disposed in, on, or about the device. Other shapes, styles and configurations can be equally employed to provide the one or more device latches 130.

In one or more embodiments, the one or more device latches 130 can be disposed in at least two positions, a first position 180 corresponding to an "unlocked" condition, and a second position 185, corresponding to a "locked" condition. In one or more embodiments, when the one or more device latches 130 are disposed in the first "unlocked" position 180, the device can be freely attached and detached, i.e. "detachably attached," from the base member 110. In one or more embodiments, when the one or more device latches 130 are disposed in the second "locked" position 185, the device cannot be detached from the base member 110. In one or more embodiments, one or more releases 160, for example one or more buttons, latch releases, or similar, can be used to effectuate the detachment of the device from the base member 110 when the one or more device latches 130 are disposed in the first "unlocked" position.

The one or more cable latches 140 can include any number of devices, systems, or combinations of systems and devices suitable for attaching, affixing, engaging, or otherwise securing a cable to the base member 110. In one or more embodiments, at least a portion of the cable latch 140 can be disposed proximate at least a portion of the aperture 120. In one or more specific embodiments, all or a portion of the cable latch 140 can be a metallic or non-metallic, single or multi-part, member having a notch, slot, groove, or other indentation suitable for disposal proximate the cable.

In one or more embodiments, the one or more cable latches 140 can be disposed in at least two positions, a first position 190 corresponding to an "unlocked" condition, and a second position 195, corresponding to a "locked" condition. In one or more embodiments, when the one or more cable latches 140 are disposed in the first "unlocked" position 190, the cable can be freely attached and detached from the base member 110. In one or more embodiments, when the one or more cable latches 140 are disposed in the second "locked" position 195, the cable cannot be detached from the base member 110.

The lock assembly 150 can include any number of devices, systems, or combination of systems and devices suitable for manipulating or otherwise alternating the one or more device latches 130 and the one or more cable latches 140 between at least the first, "unlocked" position 180, 190 (respectively) and the second, "locked" position 185, 195 (respectively). In one or more embodiments, the lock assembly 150 can include one or more electronic locks having a plurality of modes or positions, for example one or more locks using a keypad or similar data entry method to alternate between at least a first, second, and third mode or position. In one or more embodiments, the lock assembly 150 can include one or more physical, mechanical, electrical, or electromechanical devices or locks having at least three (3) or more modes or positions.

In one or more embodiments, the lock assembly 150 can be a keyed lock having a plurality of positions. In one or more specific embodiments, the lock assembly 150 can be a tubular pin tumbler lock using a tubular or barrel key to open. In one or more specific embodiments, the lock assembly 150 can have at least three positions, corresponding to a first, second, and third mode of operation. In one or more embodiments, the lock assembly 150 can have at least three modes or positions, where the key cannot be removed from the lock assembly 150 when the lock assembly 150 is disposed in one or more modes, for example when the lock assembly 150 is disposed in the first, "unlocked" mode. In one or more embodiments, the various lock assembly 150 modes can provide differing combinations of positions for the one or more device latches 130 and the one or more cable latches 140, for example the positions as depicted in FIGS. 1A through 1C.

Figure 1A:
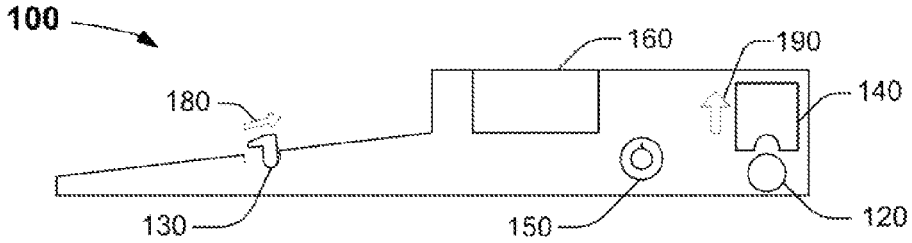
FIG. 1A is a partial sectional view of the exemplary cable lock system depicted in FIG. 1, along line 1A-1A, with the system disposed in an illustrative first mode, according to one or more embodiments described herein.

FIG. 1A is a partial sectional view of the exemplary cable lock system 100 depicted in FIG. 1, along line 1A-1A, with the system 100 disposed in an illustrative first mode, according to one or more embodiments. In one or more specific embodiments, the lock assembly 150 can have a first mode or position disposing the one or more device latches 130 and the one or more cable latches 140 in the first, "unlocked" position 180, 190 as depicted in FIG. 1A. When the one or more device latches 130 are in the first "unlocked" position 180, a device can be freely attached and detached from the one or more device latches 130. When the one or more cable latches 140 are in the first "unlocked" position 190, a cable can be freely attached and detached from the one or more cable latches 140, for example by passage through the one or more apertures 120.

Figure 1B:
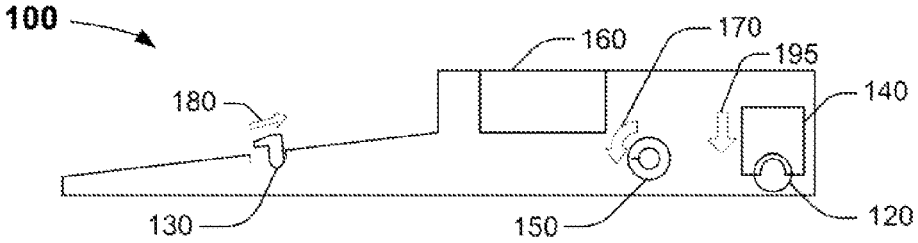
FIG. 1B is a partial sectional view of the exemplary cable lock system depicted in FIG. 1, along line 1B-1B, with the system disposed in an illustrative second mode, according to one or more embodiments described herein.

FIG. 1B is a partial sectional view of the exemplary cable lock system 100 depicted in FIG. 1, along line 1B-1B, with the system 100 disposed in an illustrative second mode, according to one or more embodiments. In one or more specific embodiments, the lock assembly 150 can be rotated or otherwise displaced 170 into the second mode or position, disposing the one or more cable latches 140 into a second, "locked" position 195 while maintaining the one or more device latches 130 in the first, "unlocked" position 180, as depicted in FIG. 1B. When the one or more cable latches 140 are disposed in the second "locked" position 195, a cable attached to the one or more cable latches 140 cannot be detached or otherwise removed from the one or more cable latches 140. Additionally, in one or more specific embodiments, while the one or more cable latches 140 are in the second "locked" position 195, a cable cannot be attached or otherwise introduced to the one or more cable latches 140.

Figure 1C:
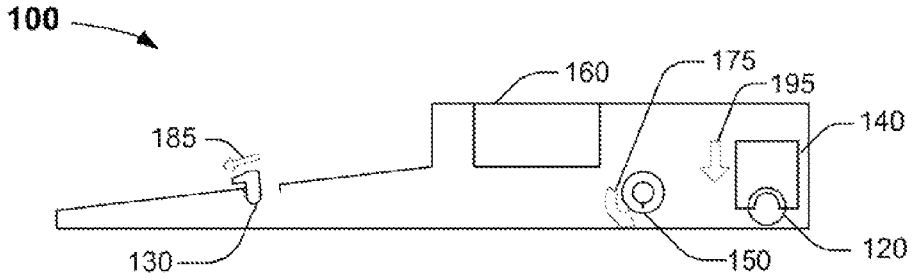
FIG. 1C is a partial sectional view of the exemplary cable lock system depicted in FIG. 1, along line 1C-1C, with the system disposed in an illustrative third mode, according to one or more embodiments described herein.

FIG. 1C is a partial sectional view of the exemplary cable lock system 100 depicted in FIG. 1, along line 1C-1C, with the system disposed in an illustrative third mode, according to one or more embodiments. In one or more specific embodiments, the lock assembly 150 can be further rotated or otherwise displaced 175 into the third mode or position thereby disposing the one or more device latches 130 into the second, "locked" position 185 while maintaining the one or more cable latches 140 in the second, "locked" position 195, as depicted in FIG. 1C. When the one or more device latches 130 are disposed in the second "locked" position 185, a device attached to the one or more device latches 130 cannot be detached or otherwise removed from the one or more device latches 130. Additionally, in one or more specific embodiments, when the one or more device latches 130 are in the second "locked" position 185, a device cannot be attached or otherwise introduced to the one or more device latches 130.

Figure 2:
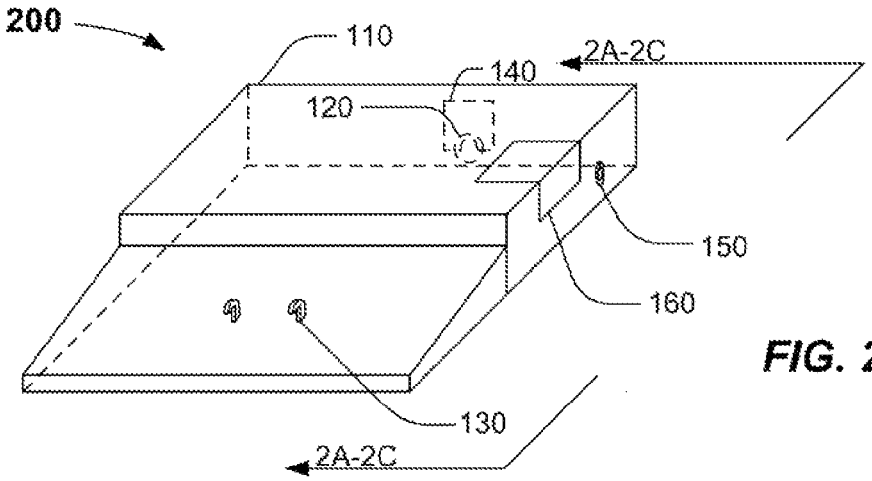
FIG. 2 is an upper-front perspective view of another exemplary cable lock system, according to one or more embodiments described herein.

FIG. 2 is an upper-front perspective view of another exemplary cable lock system 200, according to one or more embodiments. In one or more embodiments, the system 200 can include a device latch tension member 210 and a cable latch tension member 220. In one or more embodiments, the device latch tension member 210 and the cable latch tension member 220 can be anchored or otherwise attached to the base member 110. In one or more embodiments, the device latch tension member 210 can be used to bias the device latch to the second, "locked" position 185. In one or more embodiments, the cable latch tension member 220 can be used to bias the cable latch to the second "locked" position 195.

The device latch tension member and the cable latch tension member 210, 220, can be any number of systems, devices, or combination systems and devices suitable for providing a restorative force to the device latch 130 and the cable latch 140, respectively. In one or more embodiments, the device latch tension member and the cable latch tension member 210, 220, can be a spring, for example a tension coil spring anchored to the latch at a first end and to an anchor affixed to the base member 110 at the second end.

Figure 2A:
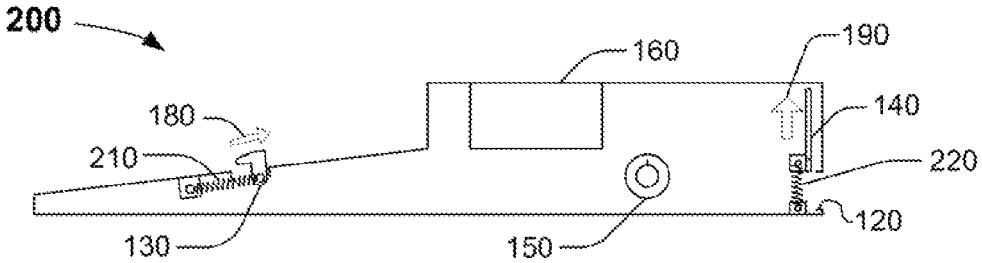
FIG. 2A is a partial sectional view of the exemplary cable lock system depicted in FIG. 2, along line 2A-2A, with the system disposed in an illustrative first mode, according to one or more embodiments described herein.

FIG. 2A is a partial sectional view of the exemplary cable lock system 200 depicted in FIG. 2, along line 2A-2A, with the system 200 disposed in an illustrative first mode, according to one or more embodiments. In one or more specific embodiments, the lock assembly 150 can be disposed in the first mode or position, disposing the one or more device latches 130 and the one or more cable latches 140 into the first, "unlocked" position 180, 190 as depicted in FIG. 2A. Placing the one or more device latches 130 and the one or more cable latches 140 into the first "unlocked" position 180, 190 can extend the tension members 210, 220, thereby imposing a restorative force biasing or otherwise driving the one or more device latches 130 and the one or more cable latches 140 back to the second, "locked" position 185, 195.

Figure 2B:
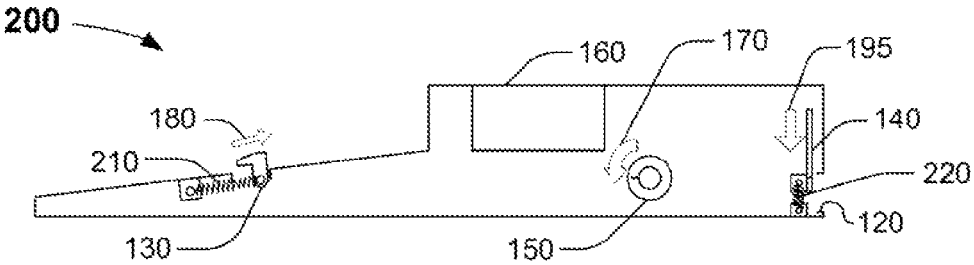
FIG. 2B is a partial sectional view of the exemplary cable lock system depicted in FIG. 2, along line 2B-2B, with the system disposed in an illustrative second mode, according to one or more embodiments described herein.

FIG. 2B is a partial sectional view of the exemplary cable lock system 200 depicted in FIG. 2, along line 2B-2B, with the system 200 disposed in an illustrative second mode, according to one or more embodiments. In one or more specific embodiments, the lock assembly 150 can be rotated or otherwise displaced 170 to the second mode or position, disposing the one or more cable latches 140 into the second, "locked" position 195 while maintaining the one or more device latches 130 in the first, "unlocked" position 185 as depicted in FIG. 2A. The cable latch tension member 220 can provide all or a portion of the restorative force necessary to place the one or more cable latches 140 in the second, "locked" position depicted in FIG. 2B. In one or more specific embodiments, the tension member 220 can permit the non-detachable attachment of the cable to the one or more cable latches 140 by permitting the temporary displacement from, and return to, the second, "locked" position 195 of the one or more cable latches 140 when the cable is mated with or otherwise attached to the one or more cable latches 140.

Figure 2C:
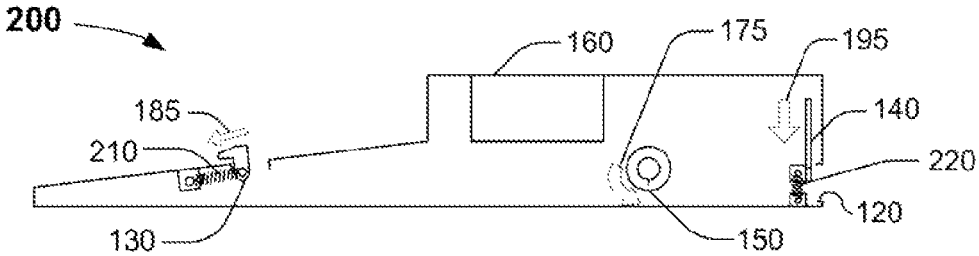
FIG. 2C is a partial sectional view of the exemplary cable lock system depicted in FIG. 1, along line 2C-2C, with the system disposed in an illustrative third mode, according to one or more embodiments described herein.

FIG. 2C is a partial sectional view of the exemplary cable lock system 200 depicted in FIG. 1, along line 2C-2C, with the system 200 disposed in an illustrative third mode, according to one or more embodiments. In one or more specific embodiments, the lock assembly 150 can be rotated or otherwise displaced 175 to the third mode or position, thereby placing the one or more device latches 130 into the second, "locked" position 185, while maintaining the one or more cable latches 140 into the second, "locked" position 195 as depicted in FIG. 2B. The device latch tension member 210 can provide all or a portion of the restorative force necessary to place the one or more device latches 130 in the second, "locked" position 185 depicted in FIG. 2C. In one or more specific embodiments, the tension member 210 can permit the non-detachable attachment of the device to the one or more device latches 130 by permitting the temporary displacement and return to the second, "locked" position 185 of the one or more device latches 130 when the device is mated with or otherwise attached to the one or more device latches 130.

Figure 3A:
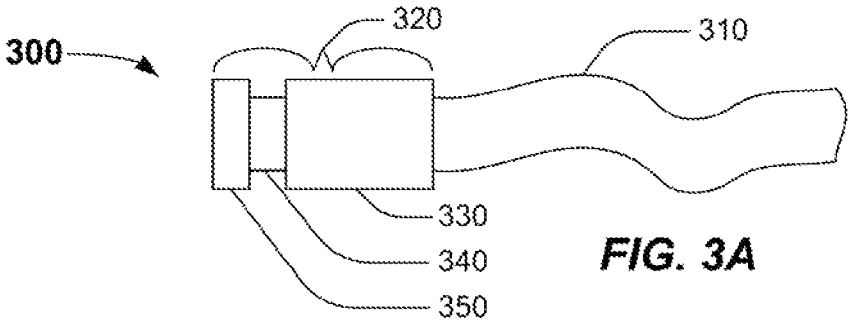
FIG. 3A is an elevation of an exemplary cable having an illustrative first end, according to one or more embodiments described herein.

FIG. 3A is an elevation of an exemplary cable 300 having an illustrative first end 320, according to one or more embodiments. In one or more embodiments, the cable 300 can include a flexible member 310 having all or a portion of the first end 320 permanently or temporarily attached thereto. In one or more embodiments, the first end 320 can include a first, generally cylindrical, section 330 having a first diameter; a second, generally cylindrical, section 340 having a second diameter; and a third, generally cylindrical, section 350 having a third diameter. In one or more specific embodiments, the second diameter can be less than both the first diameter and the third diameter as depicted in FIG. 3A. In one or more specific embodiments, the third diameter can be similar to, or the same as, the first diameter.

In one or more embodiments, the flexible member 310 can be a flexible, metallic or non-metallic, member. In one or more embodiments, the flexible member 310 can be a metallic cable having a second end. In one or more specific embodiments, the second end of the flexible member 310 can be formed into a closed loop, for example through the use of a permanent clamping means to affix or otherwise attach the second end of the cable to itself. In one or more embodiments, the flexible member 310 can be a metallic cable having a resilient polymeric coating disposed about the circumference of all or a portion of flexible member 310. In one or more embodiments, the flexible member 310 can be a continuous member, for example a metallic cable. In one or more embodiments, the flexible member 310 can be a plurality of linked or interconnected members, for example a chain formed from a plurality of individual links. In one or more embodiments, the flexible member 310 can be a metallic cable having a diameter of from about 0.25 mm to about 10 mm; about 0.50 mm to about 8 mm; or about 0.75 mm to about 6 mm.

In one or more embodiments, the first section 330, second section 340, and third section 350 of the first end 320 can be a metallic or a non-metallic material. In one or more embodiments, the first end 320 can include a plurality of individual components providing the first 330, second 340, and third 350 sections. In one or more embodiments, the first end 320 can include a single component machined, cast, or otherwise fabricated to provide the first 330, second 340, and third 350 sections. In one or more embodiments, the first section 330 can have a diameter of from about 1 mm to about 20 mm; about 3 mm to about 18 mm; or about 5 mm to about 15 mm. In one or more embodiments, the second diameter of the second section 340 can be less than the first diameter, of from about 1 mm to about 20 mm; about 3 mm to about 18 mm; or about 5 mm to about 15 mm. In one or more embodiments, the third diameter of the third section 350 can be greater than the second diameter. In one or more embodiments, the third diameter can be about 1 mm to about 20 mm; about 3 mm to about 18 mm; or about 5 mm to about 15 mm.

Figure 3B:
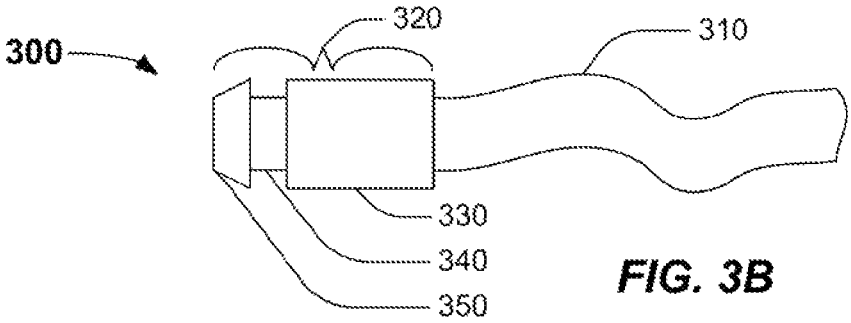
FIG. 3B is an elevation of an exemplary cable having another illustrative first end, according to one or more embodiments described herein.

FIG. 3B is an elevation of an exemplary cable 300 having another illustrative first end 320, according to one or more embodiments. In one or more embodiments, the third section 350 can have any geometry or shape having a circular cross section. For example, the third section 350 can be spherical, cylindrical, ellipsoidal, conical, or frustoconical. In one or more specific embodiments, the third section 350 can have a frustoconical shape, with the smaller diameter disposed distal from the second section 340 and the larger diameter disposed proximate the second section 340. In one or more embodiments, the third section 350 can have a frustoconical shape as depicted in FIG. 3B, with the larger diameter substantially similar to the diameter of the first section 330. In one or more specific embodiments, the third section 350 can have a frustoconical shape, having a smaller diameter of from about 2 mm to about 15 mm; from about 3 mm to about 12 mm, or about 4 mm to about 10 mm. In one or more specific embodiments, the third section 350 can have a frustoconical shape, having a larger diameter of from about 5 mm to about 20 mm; about 5 mm to about 18 mm; or about 5 mm to about 15 mm.

In one or more specific embodiments, the cable latch 140 can be a metallic member having a slot, groove, detent, or other indentation of sufficient dimension and having sufficient clearance for disposal about the second section 340 of the first end 320 while having insufficient clearance for disposal about the first 330 and third sections 350 of the first end 320. In one or more specific embodiments, the cable latch 140 can be a member having a configuration suitable for the passage of a frustoconical third section 350 while being unsuitable for the passage of the cylindrical first section 330.

Figure 3C:
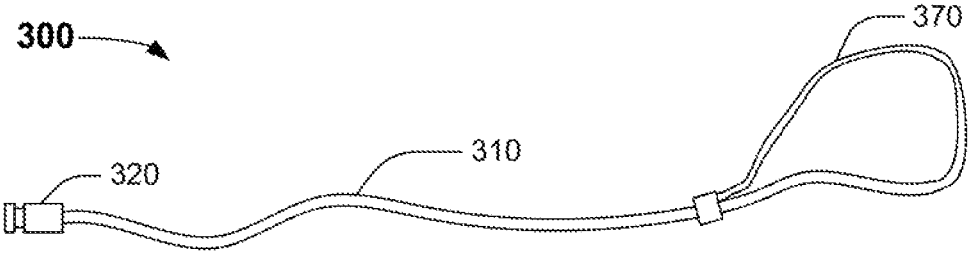
FIG. 3C is an elevation of an exemplary cable having a first end and a second end forming a loop, according to one or more embodiments described herein.

FIG. 3C is an elevation of an exemplary cable 300 having a first end 320 and a second end forming a loop 370, according to one or more embodiments. In one or more specific embodiments, the second end of the cable 300 can be formed into a loop 370 as depicted in FIG. 3C. The inclusion of the loop 370 on the second end of the cable 300 can facilitate "looping" the first end of the cable about an immovable object and then through the open portion of the loop 370, thereby anchoring any device attached to the first end 320 of the cable 300 to the immovable object.

Figure 4:
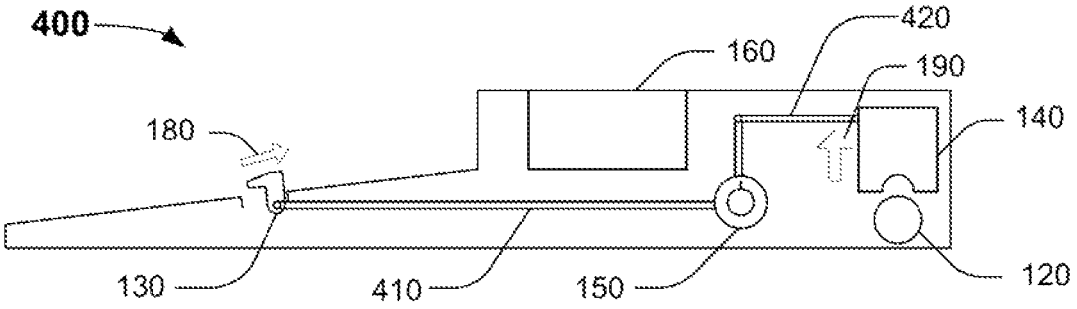
FIG. 4 is a partial sectional view of the exemplary cable lock system depicted in FIG. 1, depicting illustrative connecting members, according to one or more embodiments described herein.

FIG. 4 is a partial sectional view of an exemplary cable lock system 400 depicting illustrative connecting members 410 and 420, according to one or more embodiments. In one or more embodiments, one or more connecting members 410 can be used to operably connect the one or more device latches 130 to the lock assembly 150. In one or more embodiments, one or more connecting members 420 can be used to operably connect the one or more cable latches 140 to the lock assembly 150.

The one or more connecting members 410 can be any mechanical, electrical, or electro-mechanical device, system, or combination of systems and/or devices suitable for operably connecting the lock assembly 150 with the one or more device latches 130. In one or more embodiments, the one or more connecting members 410 can maintain the one or more device latches 130 in the first, "unlocked" position 180 when the lock assembly 150 is disposed in the first or second modes or positions, previously described in detail with reference to FIGS. 1 and 2. In one or more embodiments, the one or more connecting members 410 can maintain the one or more device latches 130 in the second, "locked" position 185 when the lock assembly 150 is disposed in the third mode or position, previously described in detail with reference to FIGS. 1 and 2.

The one or more connecting members 420 can be any mechanical, electrical, or electro-mechanical device, system, or combination of systems and/or devices suitable for operably connecting the lock assembly 150 with the one or more cable latches 140. In one or more embodiments, the one or more connecting members 420 can maintain the one or more cable latches 140 in the first, "unlocked" position 190 when the lock assembly 150 is disposed in the first mode or position, previously described in detail with reference to FIGS. 1 and 2. In one or more embodiments, the one or more connecting members 420 can maintain the one or more cable latches 140 in the second, "locked" position 195 when the lock assembly 150 is disposed in the second or third modes or positions, previously described in detail with reference to FIGS. 1 and 2.

Figure 5:
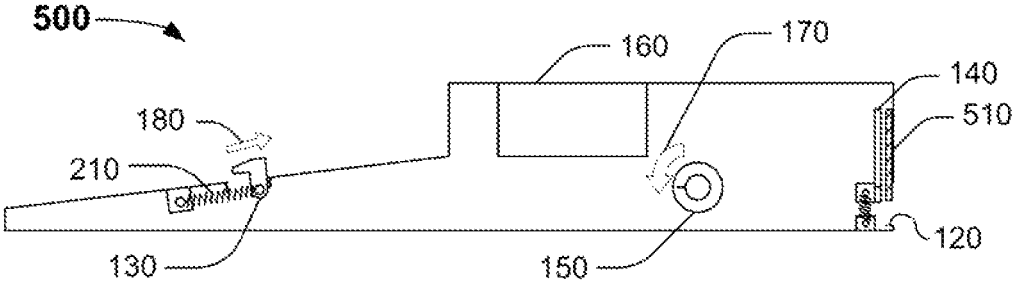
FIG. 5 is a partial sectional view of the exemplary cable lock system depicted in FIG. 2, depicting an illustrative friction member, according to one or more embodiments described herein.

FIG. 5 is a partial sectional view of another exemplary cable lock system 500 having an illustrative friction member 510, according to one or more embodiments. In one or more embodiments, one or more friction members 510 can be disposed proximate the one or more apertures 120 used for the insertion of the first end 320 of the cable 300. In one or more embodiments, the one or more friction members 510 can supply sufficient frictional force to the first end 320 of the cable 300 to prevent the detachment of the cable 300 from the base member 110 when the lock assembly 150 is in the first, "unlocked," position as previously described in detail with reference to FIGS. 1 and 2.

The one or more friction members 510 can include any device, system, or combination of systems and/or devices suitable for providing sufficient frictional force on the first end 320 of the cable 300 thereby preventing the detachment of the cable 300 from the base member 110 when the lock assembly 150 is disposed in the first, "unlocked" position. The one or more friction members 510 can include one or more members disposed proximate all or a portion of the circumference of the first end 320 of the cable 300 when disposed or otherwise attached to the one or more cable latches 140. The one or more friction members 510 can be any elastomeric compound, for example polypropylene, polyethylene, EPDM, buna rubber, butyl rubber, and the like.

Figure 6A:
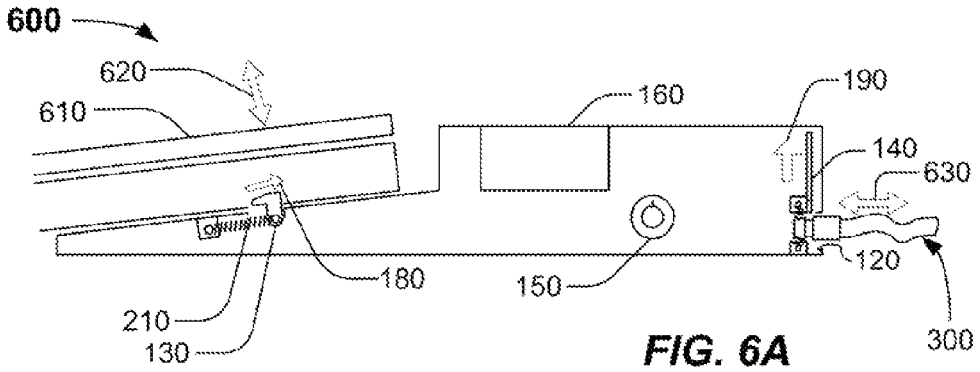
FIG. 6A is a partial sectional view of an exemplary cable lock system depicting the attachment of a device and a cable while the system is disposed in an illustrative first mode, according to one or more embodiments described herein.

FIG. 6A is a partial sectional view of an exemplary cable lock system 600 depicting the attachment of a device 610 and a cable 300 while the system 600 is disposed in an illustrative first mode, according to one or more embodiments. In one or more embodiments, when the lock assembly 150 is disposed in the first mode or position depicted in FIG. 6A, the one or more device latches 130 and the one or more cable latches 140 can be in a first, "unlocked" position 180, 190. In one or more embodiments, the one or more device latches 130 and the one or more cable latches 140 can be maintained in the in a first, "unlocked" position 180, 190 via one or more connecting members 410, 420 as described in detail with reference to FIG. 4. In one or more embodiments, a user can detachably attach 620 a device 610 to the one or more device latches 130 with the lock assembly 150 disposed in the first mode or position. In one or more embodiments, the user can detachably attach 630 a cable 300 to the one or more cable latches 140, for example by passing the first end 320 of the cable 300 through one or more apertures 120 disposed in, on, or about the base 110 with the lock assembly 150 disposed in the first mode or position.

The device 610 can include any number of devices, systems, or combination of systems and devices suitable for detachable attachment to the base member 110. In one or more specific embodiments, the device 610 can include one or more portable computing devices, one or more laptop computing devices, or one or more ultraportable computing devices. In one or more specific embodiments, the base member 110 can be adapted for the attachment of one or more devices 610 thereto via the one or more device latches 130. In one or more embodiments, the one or more device latches 130 can be disposed in, on, or about one or more corresponding apertures, indentations, or similar mating devices disposed in, on, or about the device 610 when the device 610 is attached to the one or more device latches 130.

Figure 6B:
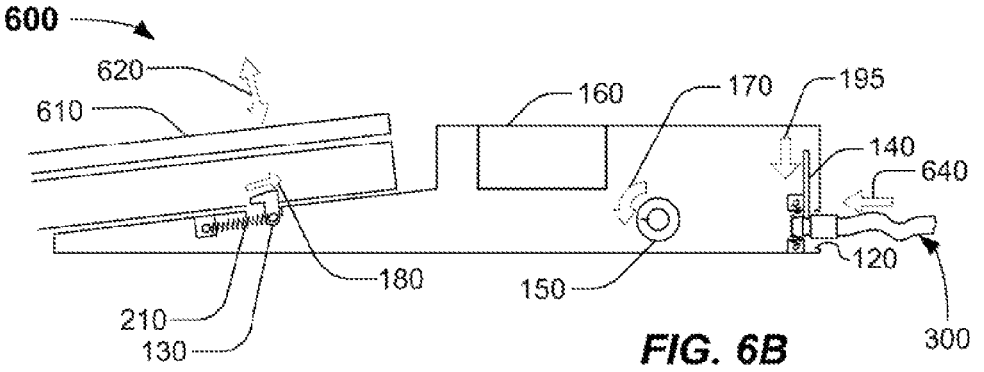
FIG. 6B is a partial sectional view of an exemplary cable lock system depicting the attachment of a device and a cable while the system is disposed in an illustrative second mode, according to one or more embodiments described herein.

FIG. 6B is a partial sectional view of the exemplary cable lock system 600 depicting the attachment of the device 610 and the cable 300 while the system 600 is disposed in an illustrative second mode, according to one or more embodiments. In one or more embodiments, the lock assembly 150 can be rotated or otherwise displaced 170 to the second mode or position depicted in FIG. 6B, for example by rotating a cylinder or barrel key within the lock assembly 150. When the lock assembly 150 is disposed in the second mode, the one or more device latches 130 can remain in a first, "unlocked" position, while the one or more cable latches 140 can be disposed in a second, "locked" position 195. In one or more embodiments, a user can detachably attach 620 a device 610 to the one or more device latches 130 with the lock assembly 150 disposed in the second mode or position. In one or more embodiments, the user cannot attach a cable 300 to the one or more cable latches 140 with the lock assembly 150 disposed in the second mode or position.

In one or more embodiments, the user can non-detachably attach a cable 300 to the one or more cable latches 140 with the lock assembly 150 disposed in the second mode or position when the tension member 420 is attached or otherwise affixed to all or a portion of the one or more cable latches 140. In one or more embodiments, as the first end 320 of the cable 300 strikes the cable latch 140, the cable latch 140 can be upwardly displaced. As the cable latch 140 is displaced the force applied by the tension member 420 can increase, for example as the length of the helical spring tension member 420 is increased. In one or more embodiments, the force applied by the tension member 420 on the one or more cable latches 140 can be proportionate to the magnitude of the displacement of the one or more cable latches 140 by the first end 320 of the cable 300. In one or more embodiments, after the third section 350 passes the one or more cable latches 140, the tension member 420 can displace the one or more cable latches 140 downward partially or completely about the reduced diameter second section 340 of the first end 320, thereby non-detachably attaching the first end 320 of the cable 300 to the cable latch 140.

The terms "upward," "downward," "upwardly," and "downwardly" and other like terms used herein refer to relative positions to another and are not intended, nor should be interpreted, to denote a particular absolute direction or spatial orientation. For example, a feature described as being on the "bottom" surface of a device could be on the "top" surface or a "side" surface of the device if the device is rotated or inverted; such rotation or inversion is envisioned to be within the scope of one or more claimed embodiments described herein.

Figure 6C:
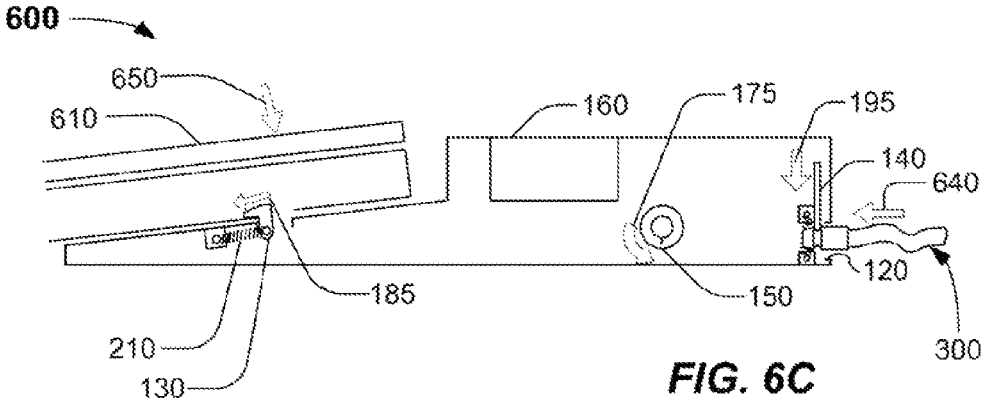
FIG. 6C is a partial sectional view of an exemplary cable lock system depicting the attachment of a device and a cable while the system is disposed in an illustrative third mode, according to one or more embodiments described herein.

FIG. 6C is a partial sectional view of the exemplary cable lock system 600 depicting the attachment of the device 610 and the cable 300 while the system 600 is disposed in an illustrative third mode, according to one or more embodiments. In one or more embodiments, the lock assembly 150 can be rotated or otherwise displaced 175 to the third mode or position depicted in FIG. 6C, for example by rotating a cylinder or barrel key within the lock assembly 150. When the lock assembly 150 is disposed 175 in the second mode, the one or more device latches 130 can be disposed in a second, "locked" position 185, while the one or more cable latches 140 can remain in the second, "locked" position 195. In one or more embodiments, a user cannot attach a device 610 to the one or more device latches 130 with the lock assembly 150 disposed in the third mode or position.

In one or more embodiments, the user can non-detachably attach a device 610 to the one or more device latches 130 with the lock assembly 150 disposed in the third mode or position when the tension member 410 is attached to the one or more device latches 130. In one or more embodiments, as the device 610 strikes the one or more device latches 130, the device latch 130 can be upwardly displaced. As the one or more device latches 130 are displaced, the force applied by the tension member 410 can increase, for example as the length of the helical spring tension member 410 is increased. In one or more embodiments, after the device 610 is attached to the base 110 via the one or more device latches 130, the tension member 410 can cause the one or more device latches 130 to return partially or completely to the second, "locked" position 185, thereby non-detachably attaching the device 610 to the one or more device latches 130.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent.

While the foregoing is directed to embodiments of the present invention, other and further embodiments of the invention may be devised without departing from the basic scope thereof, and the scope thereof is determined by the claims that follow.

What is claimed is:

1. A cable locking system comprising:

a base member having at least one aperture, a device latch, a cable latch, and a lock assembly operably connected to the device latch and the cable latch;

wherein the device latch is adapted to permit the detachable attachment of a device;

wherein the cable latch is movable from at least a first "unlocked" position to a second "locked" position to permit the detachable attachment of a cable to the cable latch of the base member;

wherein the cable latch is disposed proximate the at least one aperture; and wherein the lock assembly has at least three modes.

2. The system of claim 1, wherein the lock assembly has three modes, the three modes comprising:

a first mode wherein the device can be detachably attached to the device latch and the cable can be detachably attached to the cable latch;

a second mode wherein the device can be detachably attached to the device latch and the cable can be non-detachably attached to the cable latch; and a third mode wherein the device can be non-detachably attached to the device latch and the cable can be non-detachably attached to the cable latch.

3. The system of claim 1, wherein the lock assembly has three modes, the three modes comprising:

a first mode wherein the device can be detachably attached to the device latch and the cable can be detachably attached to the cable latch;

a second mode wherein the device can be detachably attached to the device latch and the cable is non-detachable from the cable latch; and a third mode wherein the device is non-detachable from the device latch and the cable is non-detachable from the cable latch.

4. The system of claim 1, further comprising:

a tension member biasing the device latch to a second "locked" position; and a tension member biasing the cable latch to a second "locked" position.

5. The system of claim 1, further comprising a cable, the cable comprising a flexible member and at least a first end.

6. The system of claim 1, wherein the device is selected from a group of devices consisting of: a portable computer, a laptop computer, a netbook computer, an ultra-portable computer, a personal digital assistant, and a cellular communication device.

7. The system of claim 5, wherein the first end comprises:

a cylindrical first portion having a first diameter;

a cylindrical second portion, disposed coaxially proximate the first portion, having a second diameter less than the first diameter; and a cylindrical third portion, disposed coaxially proximate, the second portion, having a diameter greater than the second diameter.

8. The system of claim 7 wherein at least a portion of the cylindrical third portion comprises a frustoconical shape.

9. The system of claim 1, wherein the operable connection between the lock assembly and the device latch comprises at least one connecting member; and wherein the operable connection between the lock assembly and the cable latch comprises at least one connecting member.

10. The system of claim 1, further comprising at least one friction member disposed proximate the aperture and the cable latch.

11. The system of claim 1, wherein the cable latch is slidable from the first "unlocked" position to the second "locked" position.

* * * * *

UNITED STATES PATENT AND TRADEMARK OFFICE

CERTIFICATE OF CORRECTION

PATENT NO. : 8,967,577 B2
APPLICATION NO. : 13/321565
DATED : March 3, 2015
INVENTOR(S) : Jeffrey Kevin Jeansonne et al.

It is certified that error appears in the above-identified patent and that said Letters Patent is hereby corrected as shown below:

On the title page item (74), Attorney, Agent, or Firm in column 2, lines 1-2, after "Brooks, Cameron & Huebsch, PLLC" and insert -- Hewlett-Packard Patent Department --, therefor.

Signed and Sealed this
Fourth Day of August, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,967,577 B2
APPLICATION NO. : 13/321565
DATED : March 3, 2015
INVENTOR(S) : Jeffrey Kevin Jeansonne et al.

It is certified that error appears in the above-identified patent and that said Letters Patent is hereby corrected as shown below:

On the title page item (74), Attorney, Agent, or Firm in column 2, lines 1-2, after "Brooks, Cameron & Huebsch, PLLC" insert -- Hewlett-Packard Patent Department --, therefor. (as corrected to read in the Certificate of Correction issued August 4, 2015) is deleted and patent is returned to its original state in the patent to read -- (74) *Attorney, Agent, or Firm* — Brooks, Cameron & Huebsch, PLLC --

Signed and Sealed this
Twenty-second Day of December, 2015

Michelle K. Lee

Michelle K. Lee
*Director of the United States Patent and Trademark Office*